US005590955A

United States Patent [19]

Bornhorst et al.

[11] Patent Number: 5,590,955

[45] Date of Patent: Jan. 7, 1997

[54] VARIABLE LIGHT MODIFIER

[75] Inventors: James M. Bornhorst, DeSoto; Bradley D. Ellis, Balch Springs; Richard W. Hutton, Irving, all of Tex.

[73] Assignee: Vari-Lite, Inc., Dallas, Tex.

[21] Appl. No.: 113,432

[22] Filed: Aug. 27, 1993

[51] Int. Cl.[6] ..... F21V 17/02

[52] U.S. Cl. ..... 362/324; 362/232; 362/283; 362/284; 362/301; 362/346; 74/490.1

[58] Field of Search ..... 362/35, 232, 233, 362/250, 277, 282, 283, 284, 319, 322, 324, 301, 449, 297, 298, 346; 74/490.03, 490.04, 490.1, 490.13, 502.1; 359/876

[56] References Cited

U.S. PATENT DOCUMENTS

| | | | |
|---|---|---|---|
| 1,400,990 | 12/1921 | Robin | 362/232 |
| 1,479,640 | 1/1924 | Bassett | 362/283 |
| 2,003,022 | 5/1935 | Thompson | 362/35 |
| 2,099,975 | 11/1937 | Hackman | 362/35 |
| 4,104,614 | 8/1978 | Litman | 362/35 |
| 4,664,698 | 5/1987 | Tomlinson | 362/272 |
| 4,729,071 | 3/1988 | Solomon | 362/35 |
| 4,769,743 | 9/1988 | Callahan | 362/18 |
| 4,777,568 | 10/1988 | Solomon | 362/35 |
| 4,827,387 | 5/1989 | Ferren et al. | 362/284 |
| 4,843,529 | 6/1989 | Izenour | 362/284 |
| 4,899,267 | 2/1990 | Mardon | 362/284 |
| 4,980,806 | 12/1990 | Taylor et al. | 362/85 |
| 4,994,946 | 2/1991 | NakaMats | 362/282 |
| 5,089,946 | 2/1992 | Mayer et al. | 362/284 |

FOREIGN PATENT DOCUMENTS

| | | | |
|---|---|---|---|
| 24312 | 3/1914 | United Kingdom | 362/282 |

*Primary Examiner*—Denise L. Gromada
*Assistant Examiner*—Alan B. Cariaso
*Attorney, Agent, or Firm*—Morgan & Finnegan

[57] ABSTRACT

A variable light modifier provides rapid beam deflection and flipping with a minimum of noise, power consumption and heat generation. In one embodiment of the invention, a dual-sided reflector is pivotable along orthogonal axes by pan and tilt mechanisms. The pan and tilt mechanisms are driven by pan and tilt motors, one or both of which remain stationary with respect to the yoke. The variable light modifier can be used to deflect light beams generated by one or more light sources and can reflect the light from one or both reflective surfaces of the reflector.

40 Claims, 15 Drawing Sheets

VARIABLE LIGHT MODIFIER

BACKGROUND

1. Field of Invention

The present invention relates to stage lighting equipment, and particularly to a motorized apparatus for directing a beam of light.

2. Discussion of the Prior Art

Motorized lighting instruments operable by remote control typically include a variety of mechanisms for adjusting the instrument's various parameters. For instance, such instruments may include a motor for adjusting azimuth (pan) and elevation (tilt). Lamp enclosure assemblies suspended between the arms of a yoke may include a motorized color changing mechanism and a motorized mechanism for altering beam dispersion properties. Instruments using an arc lamp as a source of light may employ a motorized mechanical dimmer.

Control of motorized lighting instruments typically is provided by an electronic control circuit located within the instrument itself. Such control circuits receive control signals, for instance, from a remotely located lighting system control console. In modern systems, these control signals may be digital signals generated in response to stored cue programs in the console or in response to manual adjustments to console controls. The control circuitry residing in the luminaire, therefore, in many cases is of the digital electronic variety. As is well known, such circuitry is extremely sensitive to heat.

Parameter change motors within motorized lighting instruments frequently receive power from an internal power supply. Likewise, a typical lighting instrument may include an internal power supply for lamp electronics, as well as for the lamp itself. Because of the enormous amount of heat generated by the lamp, the electronics and the position-changing motors, one or more fans usually are required to provide adequate cooling of electronic components.

In addition to the foregoing mechanical and electronic components, a typical lamp enclosure also houses the luminaire's entire optical system, including a lamp, a reflector, a color changing mechanism, a beam dispersion mechanism, and a mechanical dimmer. Depending upon the design of the lighting instrument, the lamp enclosure may also house a tilt mechanism.

One problem associated with housing electronics, parameter change motors, power supplies and optical components in a panning and tilting lamp enclosure arises from the excessive weight of the components. To initiate luminaire motion, therefore, the pan and tilt motors must overcome the inertia of the lamp enclosure, which inertia is directly related to the mass of the enclosure and its contents. Because of this large mass, a great deal of force is needed to move the enclosure. The mass of the enclosure similarly limits the speed of movement.

One approach to these problems is the use of larger and more powerful motors to overcome the inertia of the lamp enclosure. The benefit of such motors is marginal, however, because frequently one or more of such motors is housed in a movable portion of the lighting instrument, adding to the total weight to be moved and compounding the problem. In some systems, for instance, the tilt motor is housed in the rotating part of the instrument. Still other systems place both the pan and tilt motors within the movable yoke. In either case, however, placement of a motor in a movable component creates a need for larger motors than are necessary if the motor could be separated from the component to be moved.

several attempts have been made to overcome the compounding effect of placing larger motors in lighting instruments. One such attempt, as described in U.S. Pat. No. 5,089,946 to Mayer et al., utilizes a movable scanning mirror mounted along the beam path of a fixed lamp enclosure. The mirror has a reflective surface on only one side, the other side providing means for coupling the mirror to an X-Y deflection apparatus. The resulting lighting instrument is capable of high-speed beam steering, but with only a limited range of deflection.

Other attempts utilize two successive mirrors, each of which are rotated about separate axes, for azimuth and elevation adjustment. Instruments of this type are described in U.S. Pat. No. 4,663,698 to Tomlinson; U.S. Pat. Nos. 4,729,071 and 4,777,568 to Solomon; U.S. Pat. No. 4,843,529 to Izenour; and U.S. Pat. No. 4,827,387 to Ferren et al. Although there are differences among the lighting instruments described in these patents, the disclosed instruments are alike in that a light source directs a light beam toward a first mirror rotatable about a first axis, which mirror redirects the beam toward a second mirror rotatable about a second axis. The effect of such an instrument is to steer the beam in any direction without actually moving the lamp enclosure. One disadvantage of such instruments is that the use of two mirrors in succession doubles intensity losses typically experienced when a light beam is reflected from a reflective surface. Minimizing intensity losses in a dual-mirror beam-steering apparatus, therefore, requires the use of expensive, highly-reflective mirrors.

Another attempt to overcome the adverse effects of using larger motors is described in U.S. Pat. No. 4,769,743 to Callahan, which describes a system capable of high-speed beam direction about one axis. High speed beam direction is made possible by use of a low-inertia rotatable mirror mounted at one end of a tiltable lamp enclosure. The rotatable mirror provides beam direction in one coordinate, but the system still suffers from the problem arising from the excessive power needed to overcome the inertia of the lamp enclosure, which is rotatable to provide direction along another coordinate axis.

Another drawback to the above systems is that none is capable of "flipping" a light beam.

Accordingly, it is an object of the present invention to provide a variable light modifier which can direct a beam of Light quickly, accurately and precisely along more than one coordinate axis, while minimizing loss of beam intensity and the mass of the modifier's moveable components.

SUMMARY OF THE INVENTION

To overcome the above-identified problems associated with the prior art, a variable light modifier is disclosed having a yoke housing with a cross member and a pair of arms extending from opposite ends of the cross member. The variable light modifier further includes reflecting means rotatably attached to the arms, the reflecting means having a planar reflective surface, and rotating means coupled to the reflecting means for rotating the reflecting means about a first axis parallel to the cross member.

In another aspect of the invention, a method for redirecting a beam of high intensity light is described, the method including the step of disposing a dual-sided reflector unit having first and second reflective surfaces facing in opposite directions in the path of the beam. The method further includes the step of rotating the reflecting means about a first axis to redirect the beam in a first direction, and rotating the reflecting means about a second axis perpendicular to the first axis to redirect the beam in a second direction.

DETAILED DESCRIPTION OF THE INVENTION

Figure 1:
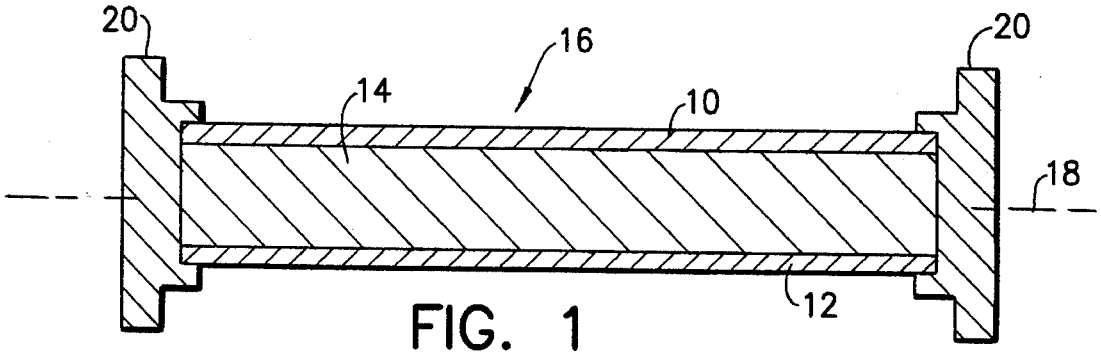
FIG. 1 is a side view of a two-sided mirror device in accordance with an embodiment of the invention.

The invention will now be described with reference to the accompanying detailed drawings. Like reference numerals correspond to like components in the various drawings.

FIG. 1 shows a two-sided mirror device 16 in accordance with one embodiment of the invention. The device 16 includes a first mirror 10 and a second mirror 12, each mirror preferably formed of thin specular aluminum sheets or glass coated with a reflective or dielectric material. The mirrors 10 and 12 are supported in back-to-back fashion by a substrate 14, which substrate may be composed of light-weight aluminum honeycomb material, or any other suitable light-weight, durable, planar material. The mirrors 10 and 12 and the substrate 14, therefore, form an integral reflecting unit in the form of two-sided mirror device 16. As also shown in FIG. 1, the device 16 can be supported for rotation about a first axis 18 by means of rotatable tilt tube 20.

Figure 2:
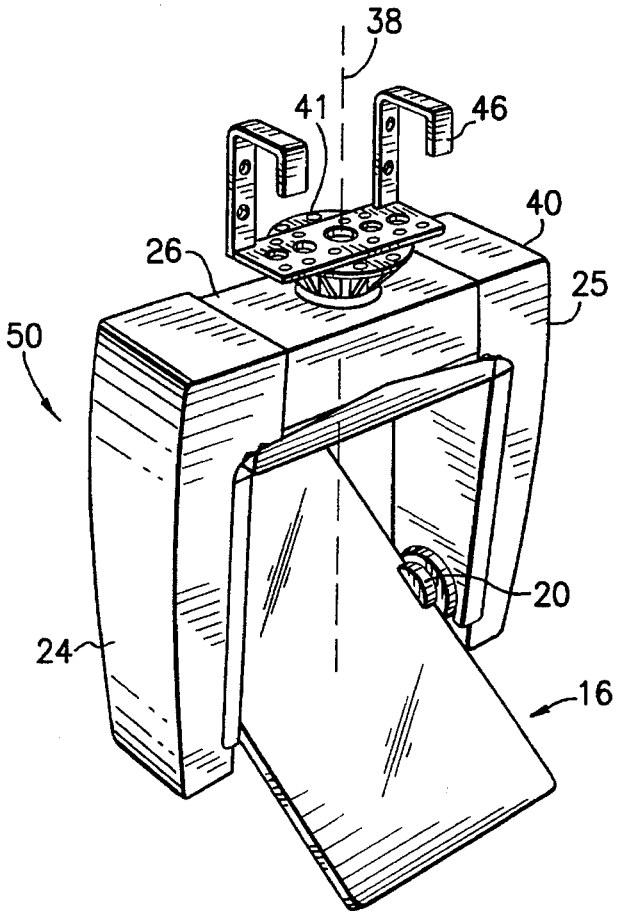
FIG. 2 is a perspective view of a variable light modifier in accordance with an embodiment of the invention.
Figure 3:
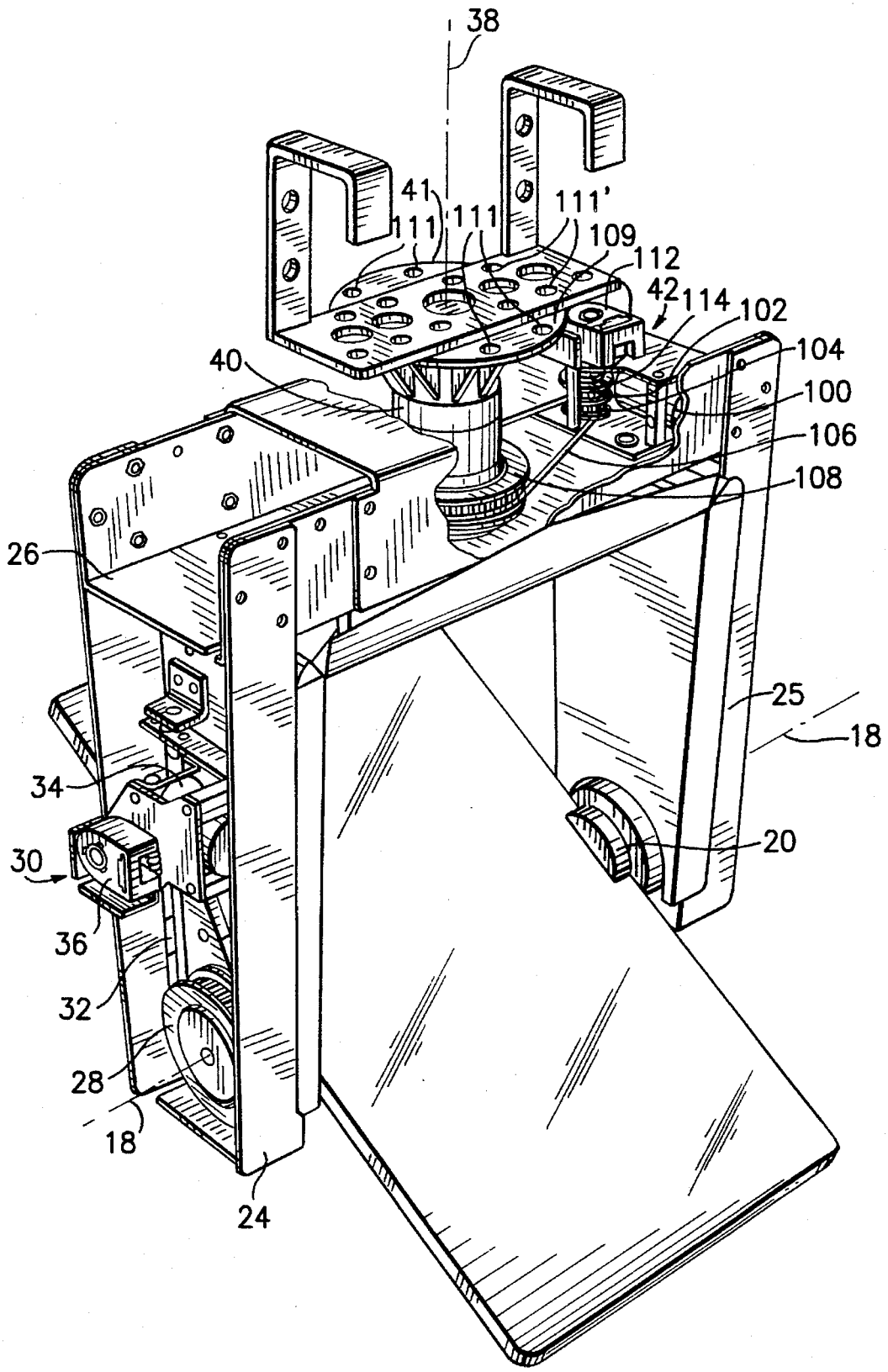
FIG. 3 is a cut away version of the perspective view of FIG. 2.

Referring now to FIG. 2, in a preferred embodiment of the invention the tilt tubes 20 are mounted in respective yoke arms 24 and 25 of a luminaire. Yoke arms 24 and 25 are supported by opposite ends of a yoke cross member 26. Yoke cross member 26 is mounted for rotation about a second axis 38 by means of pan tube 40 (FIG. 3). The entire assembly can be suspended from a lighting truss or other support means by a hook 46, or its equivalent, non-rotatably coupled to pan tube 40 by flange 41.

Means for positioning the variable light modifier of the present invention to redirect a beam of light directed to mirror device 16 will now be described with reference to FIGS. 3 and 4. As can be seen in FIG. 3, a pulley 28 is located within the hollow internal portion of yoke arm 24, the pulley being fixedly attached to tilt tube 20 for rotation about axis 18. Pulley 28 is coupled to a tilt motor assembly 30, shown in detail in FIG. 4, by a synchronous drive belt 32. Rotation of pulley 28 about axis 18 results in the rotation of mirror device 16 about the same axis, providing beam tilting. It is to be noted that mirror device 16 can be rotated a full 360° about axis 18, which allows for beam flipping.

Figure 4:
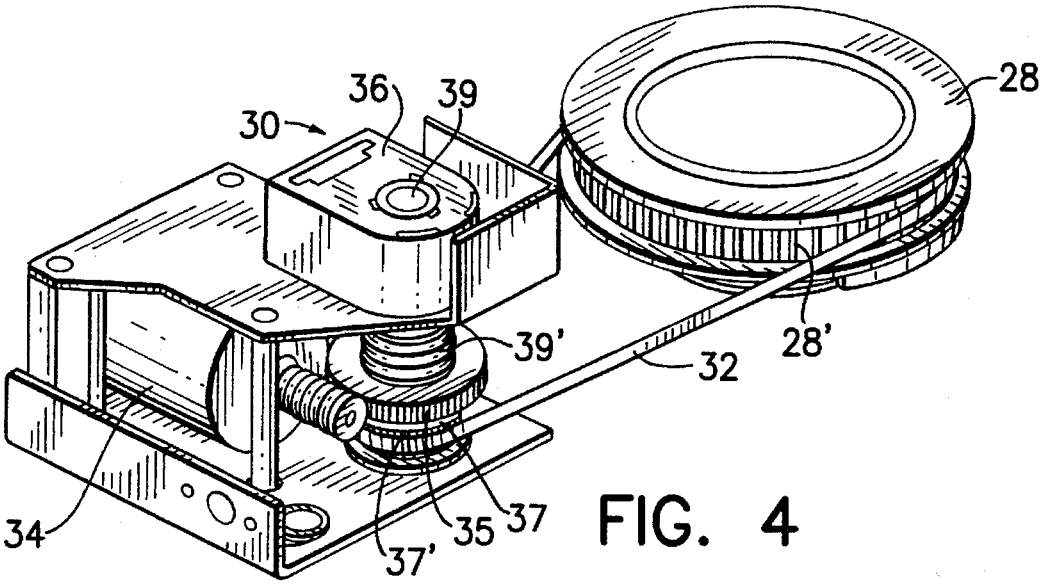
FIG. 4 is a pan motor for use in an embodiment of the invention.

The tilt motor assembly 30, as best seen in FIG. 4, includes a drive, such as DC motor 34 and an optical encoder 36. Motor 34, preferably a DC servo motor, is coupled to the drive belt 32 by a clutch, shaft and worm gear 35. The optical encoder 36 is coupled directly to a clutch shaft 39 (surrounded by a clutch spring 39') of worm gear 35. A drive pulley 37 is fixedly mounted to shaft 39. Synchronous drive belt 32 couples drive pulley 37 to driven pulley 28 to provide the driving force for rotating pulley 28, and hence mirror device 16, about tilt axis 18. Teeth (not shown on belt) may be formed in drive belt 32 which are complementary to teeth 28' and 37' on pulleys 28 and 37 to prevent belt slippage.

In a preferred embodiment, the optical encoder 36 provides incremental positional feedback signals to a local control system such as the one described in U.S. Pat. No. 4,890,806 to Taylor et al. (incorporated herein by reference). Optical encoder signals are used by the local control system to determine the pan or tilt position of the modifier. Alternatively, an analog position indicating apparatus, such as a potentiometer, can be used. An index sensor can be included to detect each full rotation of the mirror device.

Figure 19:
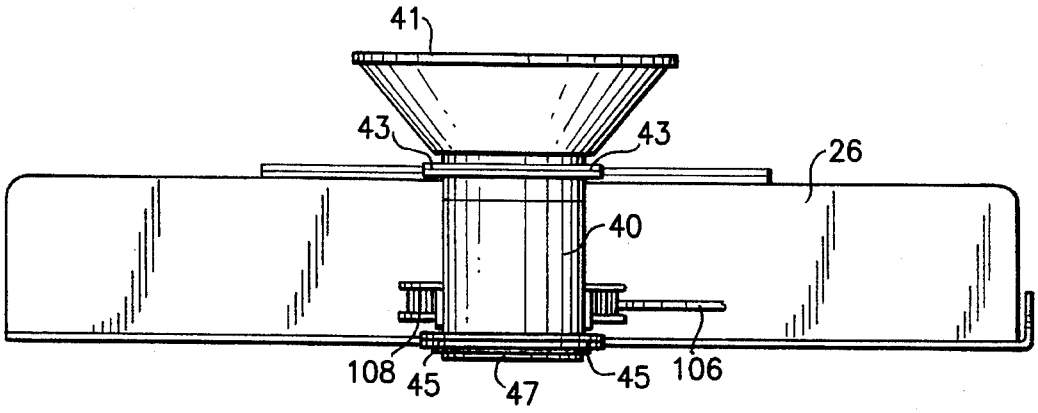
FIG. 19 is another view of the embodiment of FIG. 3.

As shown in FIG. 3, a drive, such as pan motor assembly 42, is mounted in the hollow internal portion of yoke cross-member 26. Pan motor assembly 42 preferably is identical to the tilt motor assembly 30 described above. Specifically, pan motor 100 is coupled via a worm gear 102 to a driving pulley 104. Driving pulley 104, in turn, is coupled via belt 106 to driven pulley 108. Driven pulley 108 is fixedly coupled to the pan tube 40. Yoke cross member 26 is rotatable with respect to pan tube 40 by means of bearings 43 and 45 (FIG. 19). Bearing 43 and 45 are pressed into yoke cross member 26, which is captured on pan tube 40 by means of retaining ring 47. The bearings support the yoke on the pan tube and provide means for rotating the yoke assembly about pan tube 40. Thus, rotation of pulley 104 causes the pulley 104 to "walk" along the inner surface of belt 106, causing the yoke assembly to rotate about pulley 108, and, hence, pan axis 38. Belt 106 and pulleys 104 and 108 may have complementary teeth to prevent belt slippage.

Optical encoder 112 is coupled directly to the output of shaft 114 of worm gear 102.

Figure 17:
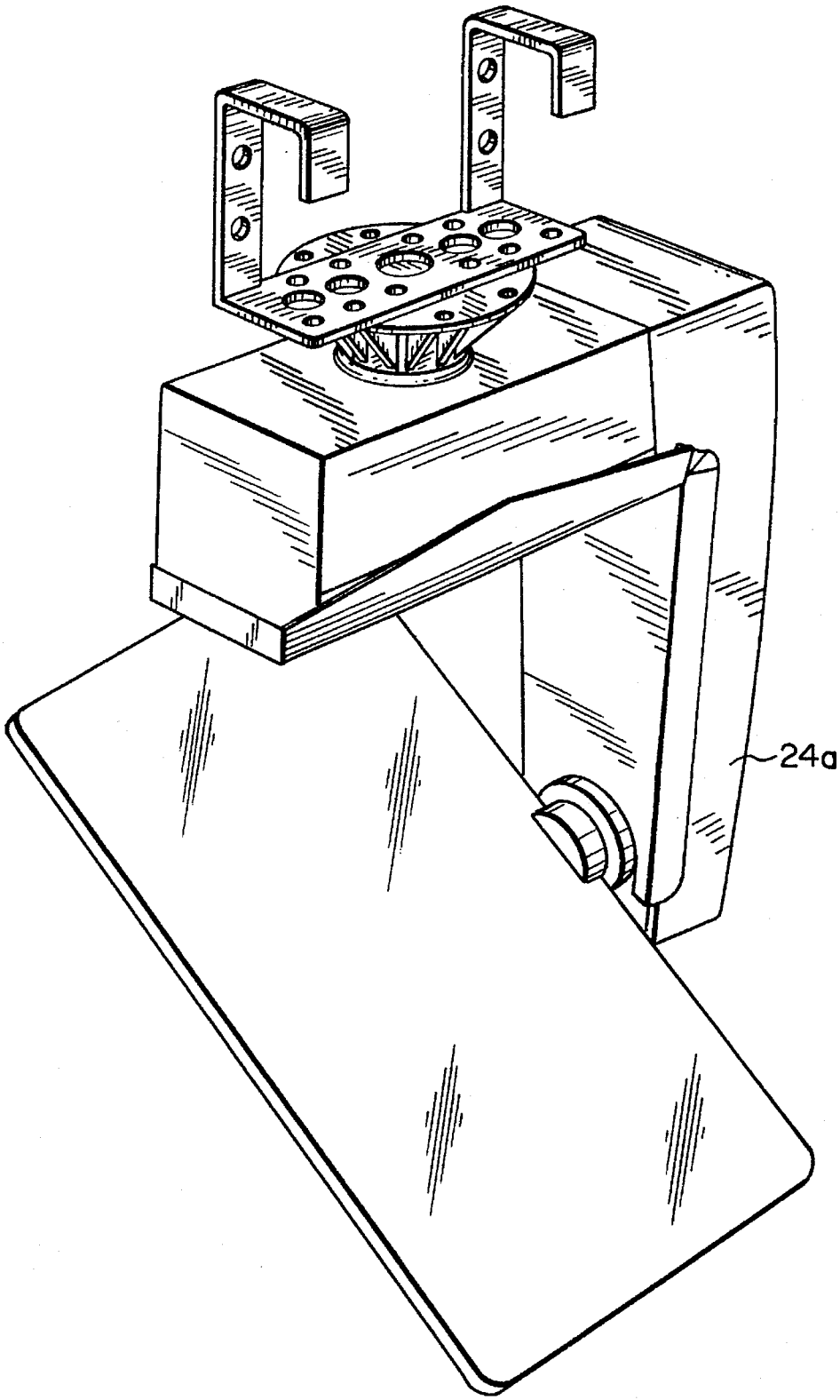
FIG. 17 shows another embodiment of a variable light modifier in accordance with the invention.

It will be noted that the variable light modifier of the present invention can include a yoke assembly having only a single yoke arm 24*a* extending down from the yoke cross member. Such an embodiment is shown in FIG. 17.

Figure 13:
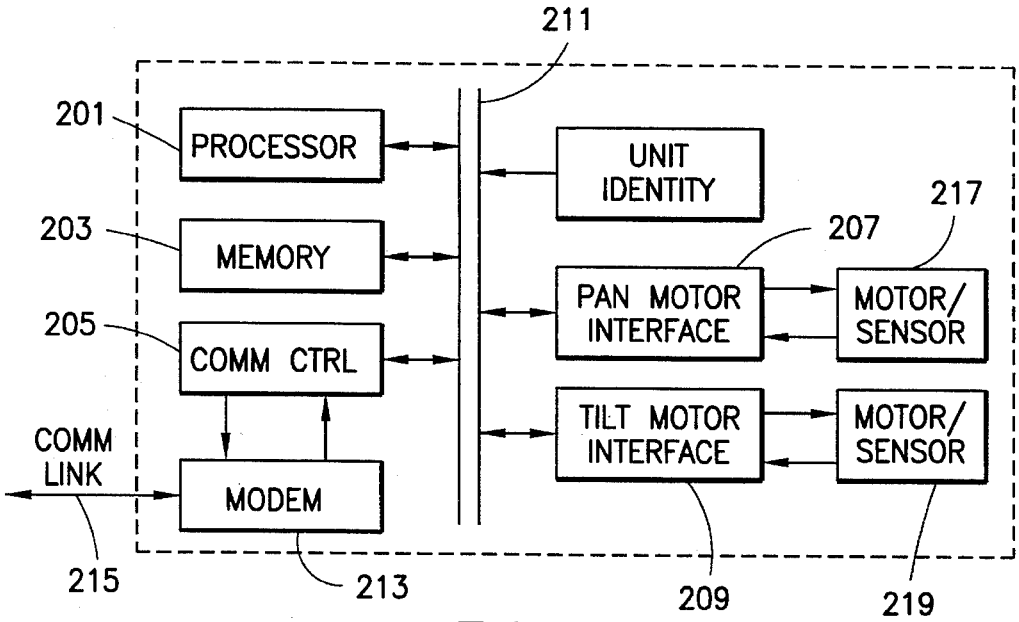
FIG. 13 is a block diagram of electrical control circuitry for operating a variable light modifier in accordance with an embodiment of the present invention.

A block diagram of the electrical local control circuitry for the pan and tilt drive mechanisms is shown in FIG. 13. The local control circuit may be configured, for instance, as described in U.S. Pat. No. 4,980,806, and be responsive to and part of a computer-controlled lighting system. Such a local control system is operable, upon receipt of appropriate system commands in the form of digital data packets, to energize pan and tilt motor assemblies to drive the yoke and mirror device to a specific position at a specified rate of travel, or to rotate either the mirror device, yoke, or both, continuously in either direction throughout their entire ranges of travel to provide desired lighting effects. A preferred communications protocol is also described in detail in U.S. Pat. No. 4,980,806.

In a preferred embodiment of the invention, the local control circuit as shown in FIG. 13 comprises a processor 201, memory 203, communications control 205, and motor interface circuits 207 and 209, all of which are coupled to an internal signal bus 211 having address, data, and control lines. The memory 203 includes both random-access memory (RAM) and long-term, read-only memory (ROM). The communications controller 205 is coupled to a modem circuit 213 which transmits and receives messages over a bidirectional, serial data bus or communication link 215. Each motor interface circuit 207 and 209 accepts digital command words from the processor 201, and energizes a motor in response to those command words. Each motor interface also accepts sensor inputs from a digital shaft encoder and from an index sensor. The motors and sensors are represented as blocks 217 and 219 in FIG. 13. Shaft encoder inputs are resolved into digital words representing the angular positions of the mirror device in both azimuth and elevation, which are then returned to the processor 201 via the internal signal bus 211 so that the processor 201 can determine when to deenergize the motors. Index sensor inputs generate interrupt signals each 360°, so the processor can determine the angular positions of the mirror device 16 in its pan and tilt directions after a period of continuous rotation.

The local control circuit can also be configured to receive DMX-512 control signals, whereby two successive data bytes are interpreted to control pan and tilt positioning. It may be desirable to designate two additional data bytes to specify the speed and direction at which continuous rotation should be effected. Because the local control circuit is processor-based with a program of executable instructions stored in the local memory, the circuit can be made responsive to any one of a plurality of control signal protocols as long as the communication link and modem are compatible.

Figure 14:
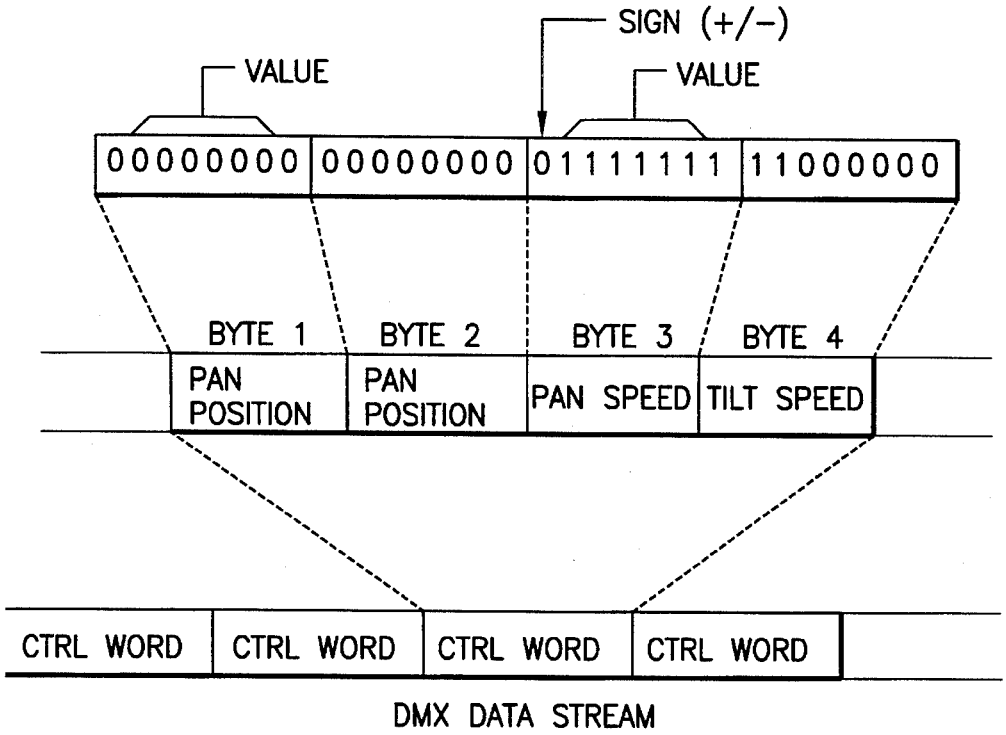
FIG. 14 shows the communication protocol used for controlling a lighting unit in accordance with one embodiment of the present invention.

As shown in FIG. 14, a DMX protocol data stream consists of a sequence of data bytes which can be interpreted by a DMX receiver as consecutive control words. Each control word is normally applicable to a single automated luminaire or other instrument, such as the variable light modifier of the present invention, and includes data specifying values for each adjustable parameter of that luminaire or instrument. In one embodiment, the first byte of a control word specifies a static position of azimuth adjustment (a pan value) while the second byte specifies a static position of elevation adjustment (a tilt value). The third byte specifies the speed and direction of continuous rotation about the pan axis, wherein one bit of the eight-bit data byte is a sign representing rotation in a "positive" or "negative" direction, while the remaining seven bits specify the speed of rotation. If the speed value is zero, the processor causes the motor interface to drive the mirror to the static position specified in the first byte of the control word. The fourth byte specifies speed and direction of continuous rotation about the tilt axis.

The local control circuit of FIG. 13 is embodied by a printed circuit board assembly (not shown), and is housed in yoke arm 25. The printed circuit board receives electrical power and control data signals via slip rings (not shown) coupled to pulley 108 (FIG. 3). An input cable assembly (not shown) delivers the electrical power and control signals to the slip rings from the lighting console. The input cable assembly exits the pan tube through an opening above the yoke cross member.

A preferred embodiment of the invention also includes means for coupling the variable light modifier to a stationary object such as a pipe or truss suspended above a performance area. Such means is provided by hook 46, which is coupled to pan tube 40 by mounting flange 41. Mounting flange 109 includes mounting holes 111, some of which are aligned with holes 111' in hook 46 for receiving bolts to secure hook 46 to the variable light modifier, allowing the modifier to be suspended above the performance area. See, for instance, the configuration of FIG. 5. Alternatively, a floor stand (not shown) may be attached to the mounting flange for supporting the variable light modifier in an inverted orientation upon a horizontal surface of the performance area.

Figure 5:
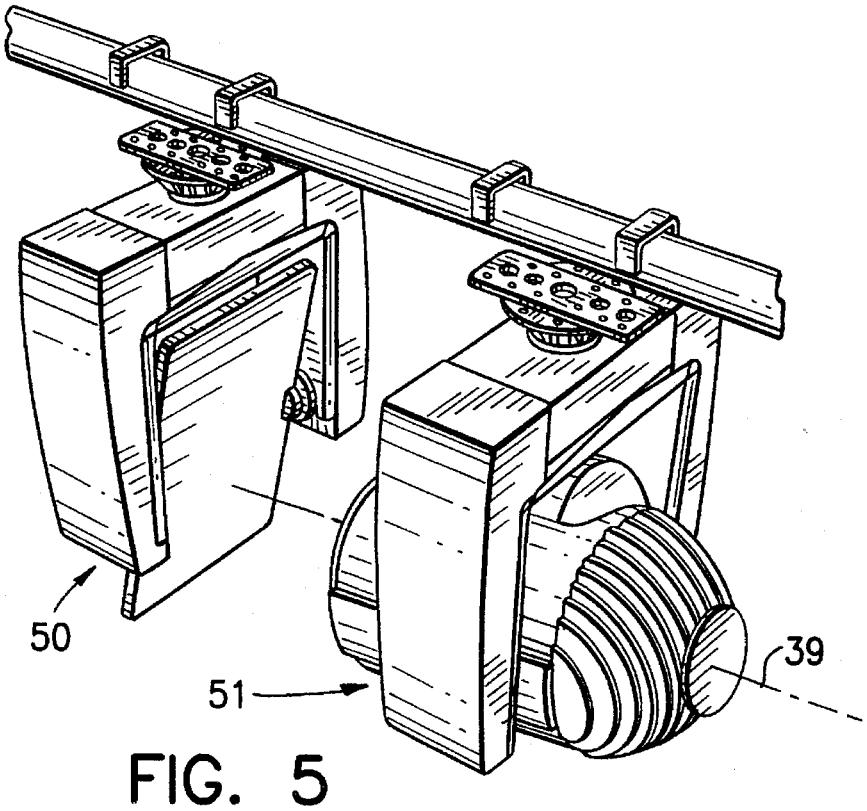
FIG. 5 is a perspective view of a variable light modifier cooperating with a lighting instrument.

In one embodiment of the invention, shown in FIG. 5, the variable light modifier can be used with a single lighting instrument to create a multitude of lighting effects. The configuration shown in FIG. 5 includes a lighting instrument 51, such as an automated luminaire, and a variable light modifier 50 which is positioned along the optical axis 39 of the beam generating means of the lighting instrument 51. A light beam generated by the lighting instrument 51 and directed along axis 39 can therefore be redirected by the variable light modifier in another direction. Redirection of the beam is effected by rotating the mirror device about its pan and tilt axes. A full 360° of coverage is attainable by the variable light modifier because of its ability to rotate independently in both the pan and tilt directions. Because the variable light modifier is housed separately from the luminaire, the configuration of FIG. 5 provides the ability to pan and tilt the generated beam to different locations on a stage without moving the relatively heavy optics and cooling systems of the luminaire itself.

Another advantage obtained when a variable light modifier in accordance with the invention is used to pan and tilt a light beam is an increase in beam positioning speed. This increase in speed, when compared with the technique of repositioning the beam by moving the lighting unit itself, results from the angular velocity of the reflected beam being twice as fast as that of the mirror surface from which the beam is reflected. This advantage is augmented by the increased angular velocity obtainable due to the relatively small mass of the movable components of the variable light modifier compared with the considerable mass of complete optical and cooling systems housed within a panning and tilting lamp enclosure.

Figure 6:
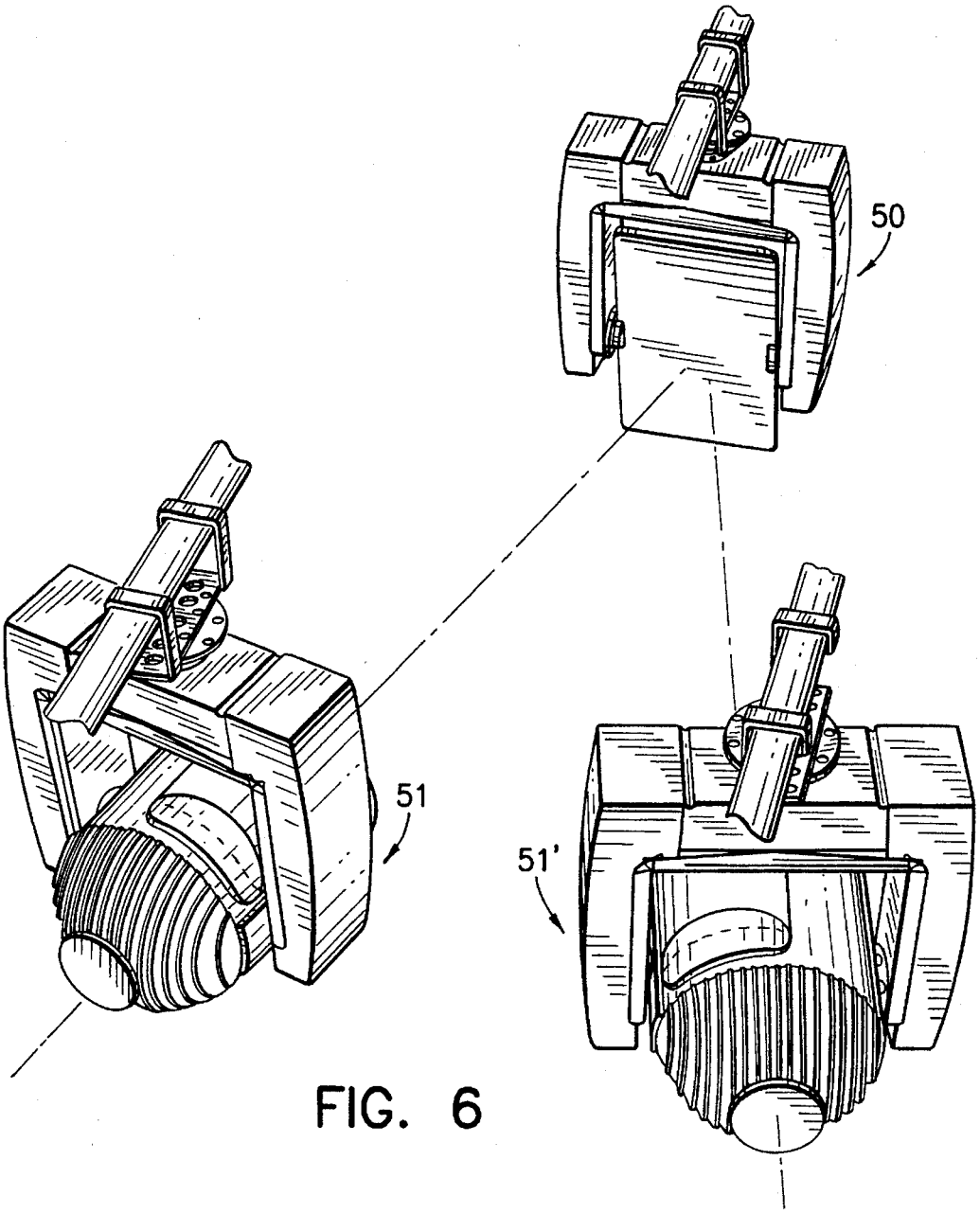
FIG. 6 is a perspective view of two lighting instruments cooperating with a single variable light modifier.

As seen in the embodiment of FIG. 6, it is apparent that the variable light modifier of the present invention is not limited to use with a single lighting instrument. The configuration of FIG. 6 shows two lighting instruments 51 and 51' whose light beams are directed toward the same reflective surface of variable light modifier 50. The number of lighting instruments which can be used simultaneously in this fashion is limited only by space considerations. The configuration of FIG. 6 can be used to create effects such as beam flipping, as well as for alternately or simultaneously panning and tilting beams generated by one or both lighting instruments.

Figure 7A:
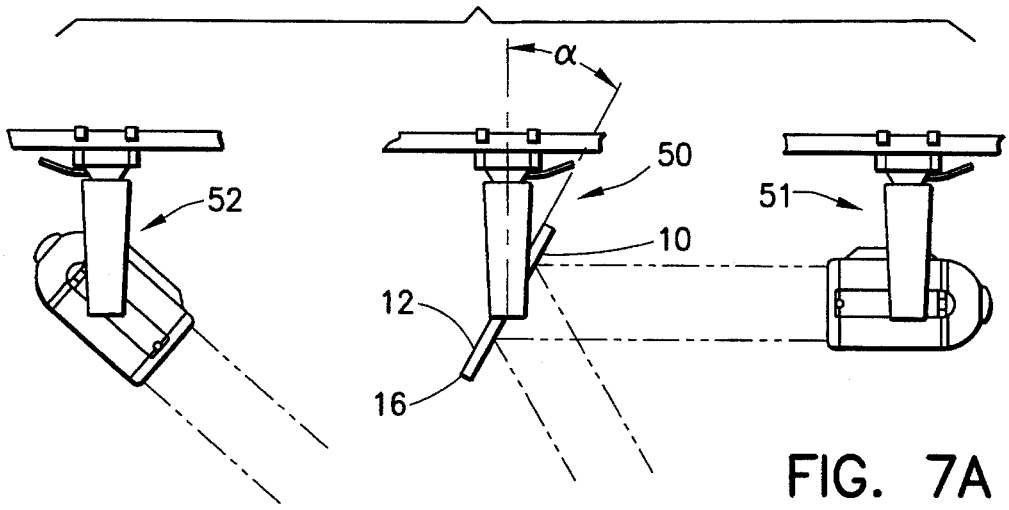
FIGS. 7A–7F are elevational views of a variable light modifier cooperating with two lighting instruments in a different way than shown in FIG. 6.
Figure 7B:
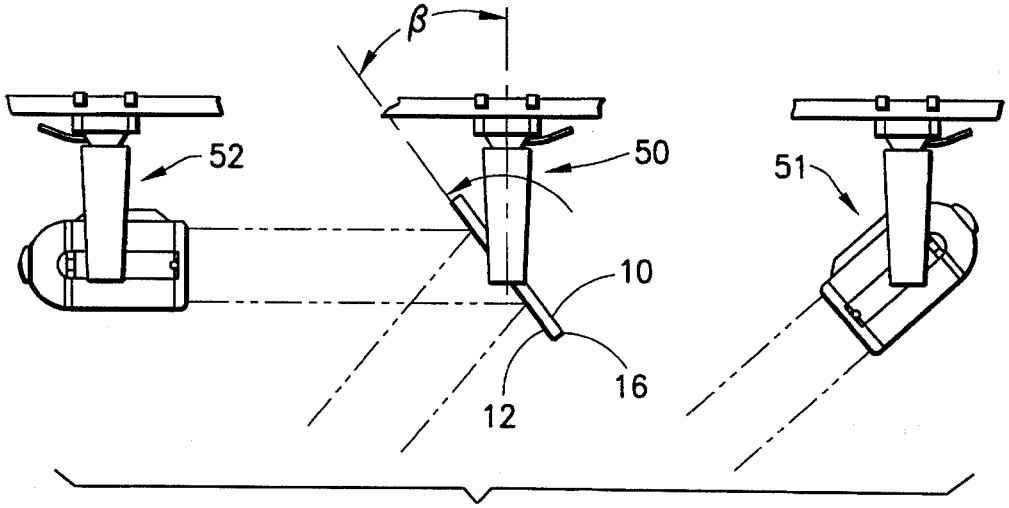
Figure 7C:
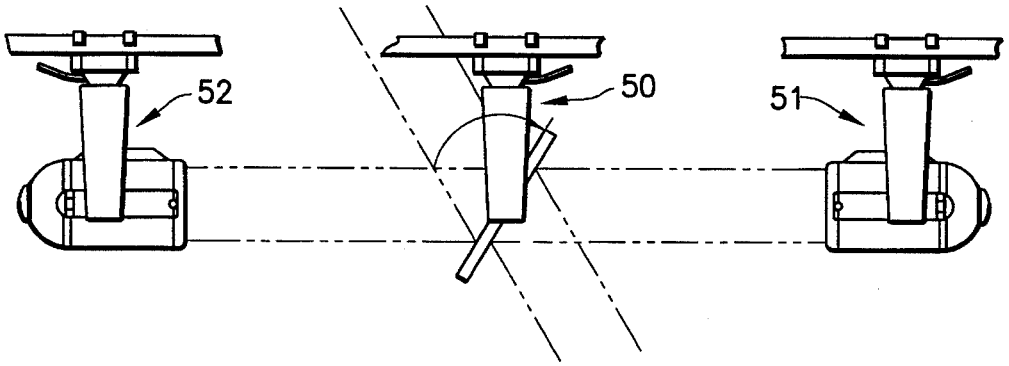
Figure 7D:
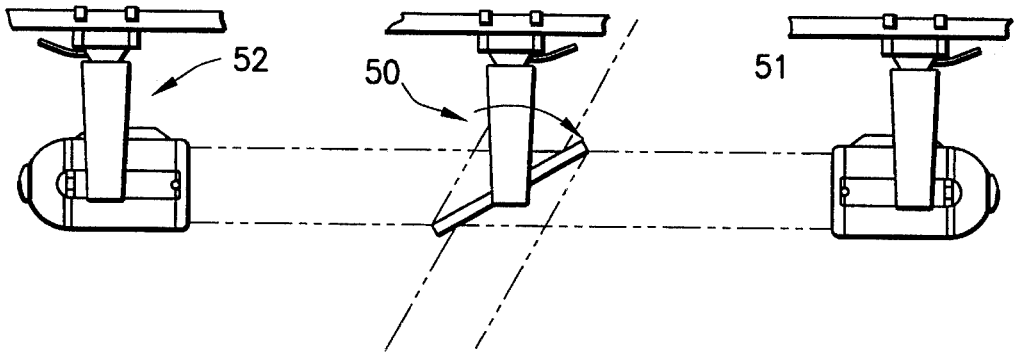
Figure 7E:
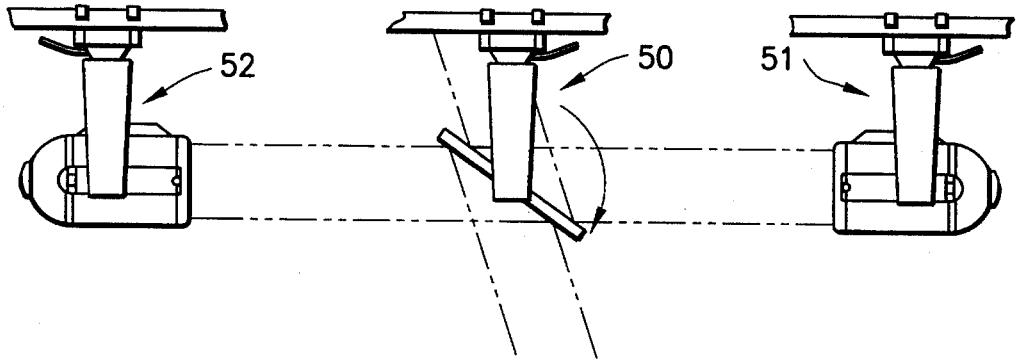
Figure 7F:
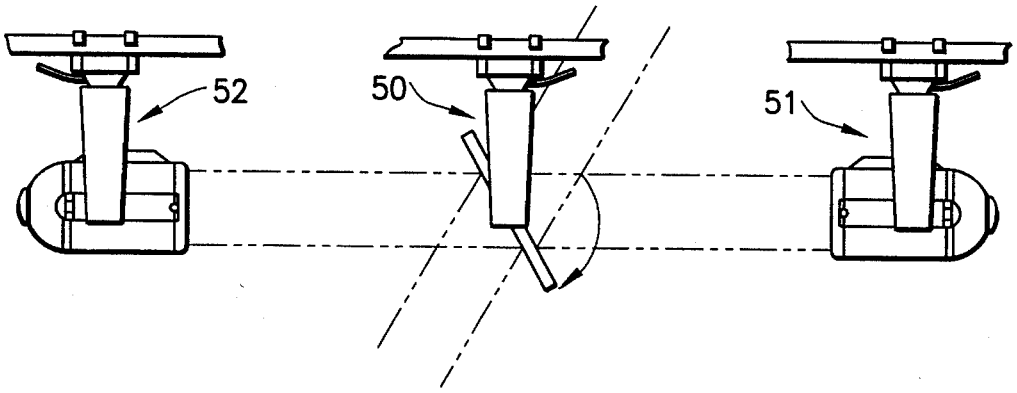

Referring now to FIGS. 7A–7B, a further advantage of the variable light modifier of the present invention will be described. The use of two-sided mirror device 16 allows the variable light modifier to be used with lighting instruments disposed on opposite sides of the modifier. Such use of a dual-sided mirror not only reduces the luminaire movement required to redirect a light beam to various locations on a stage, but also reduces the amount of movement required of the modifier itself to provide 360o pan and tilt operation. In FIG. 7A, for example, lighting instrument 52 is positioned to directly illuminate a subject, while the beam from instrument 51 is redirected by the variable modifier 50 from its initial horizontal path A along a second path B toward the subject to be illuminated. When it is desired to illuminate a different object, with instrument 51 providing direct illumination and instrument 52 providing indirect illumination, the configuration of FIGS. 7A–7B can be repositioned with a minimum of component movement.

In FIG. 7A, a light beam projected from a first lighting instrument 51 is reflected from mirror surface 10, which is positioned at an angle $\alpha$ of 30 degrees from vertical. In a subsequent lighting cue, it is desired to reflect a light beam projected from a second lighting instrument 52 off a mirror surface at an angle $\beta$ of 30 degrees from vertical. To effect this change, the two-sided mirror device is tilted counter clockwise through an angle of 60 degrees to pick-up the second beam and reflect it from mirror surface 12. A single-sided mirror device would require tilt movement through an angle of 120 degrees, or pan movement through an angle of 180 degrees, to achieve the same effect.

Another advantage of a variable light modifier in accordance with the present invention will now be described in connection with FIGS. 7C–7F. When the light beams generated by lamp units 51 and 52 are each directed toward opposite sides of the variable light modifier, dynamic beam effects are possible when the dual sided mirror element 16 mirror is rotated continuously about its tilt axis. Continuous beam flipping is not possible with a modifier utilizing a single-sided mirror device having a limited range of movement. At best, such systems are capable of one beam-flipping operation per full rotation of the mirror. Rotation of a single-sided mirror element by 360° has the effect of flipping a light beam in one complete revolution during the first 180° of movement by the mirror, but then a delay before the next flipping operation will result from the rotation-through of the non-reflective, back surface of the mirror element during the next 180° degree rotation. Because reflective surfaces are provided on both sides of the mirror element of the present invention, two beam-flipping operations can be obtained from a single revolution of the mirror element, and with no gaps. When two luminaries are used as shown in FIGS. 7C–7F, continuous beam flipping for each luminaire can be accomplished.

Figure 8:
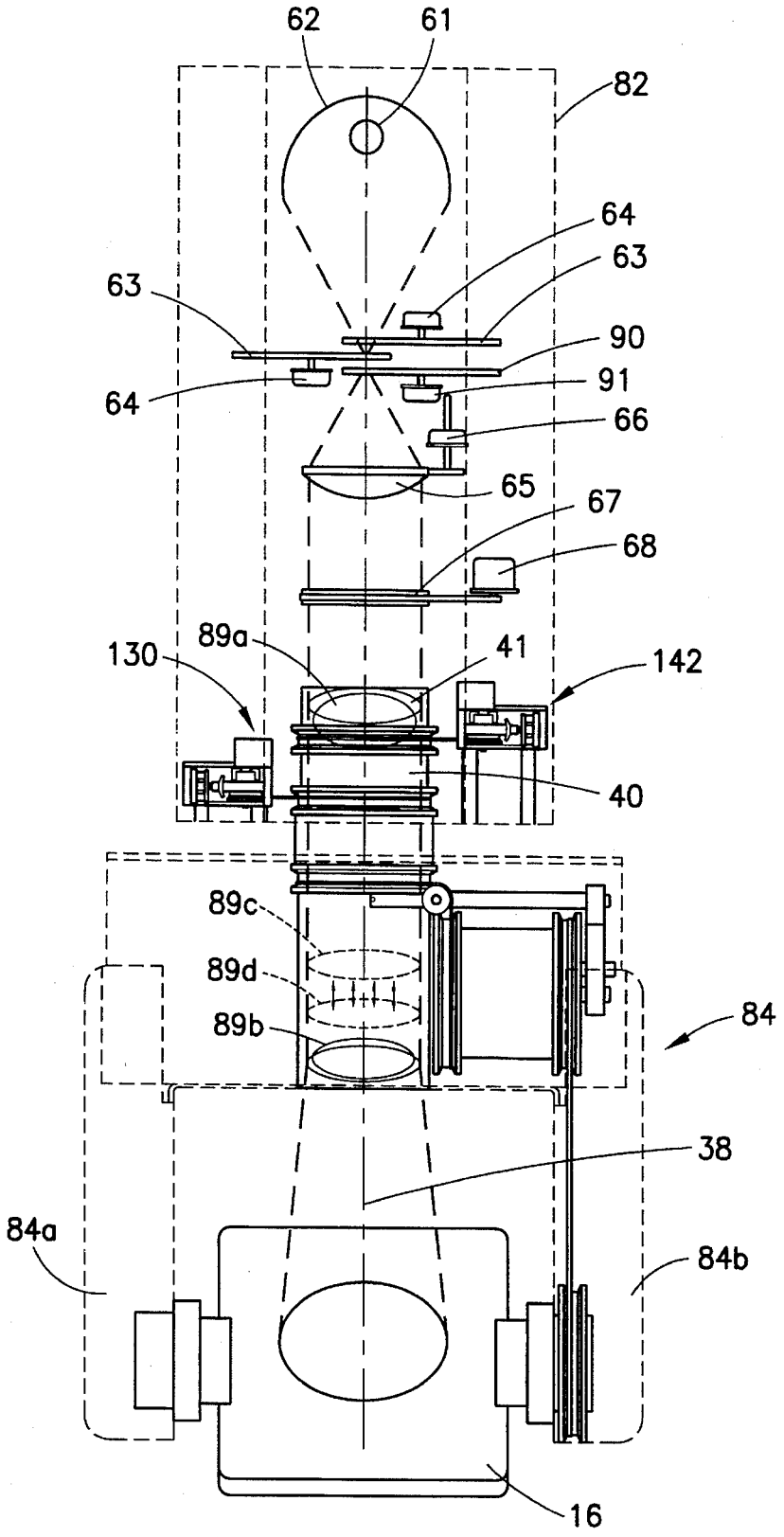
FIG. 8 is a phantom view of another embodiment of the invention, which integrates a lighting instrument and a variable light modifier.
Figure 9:
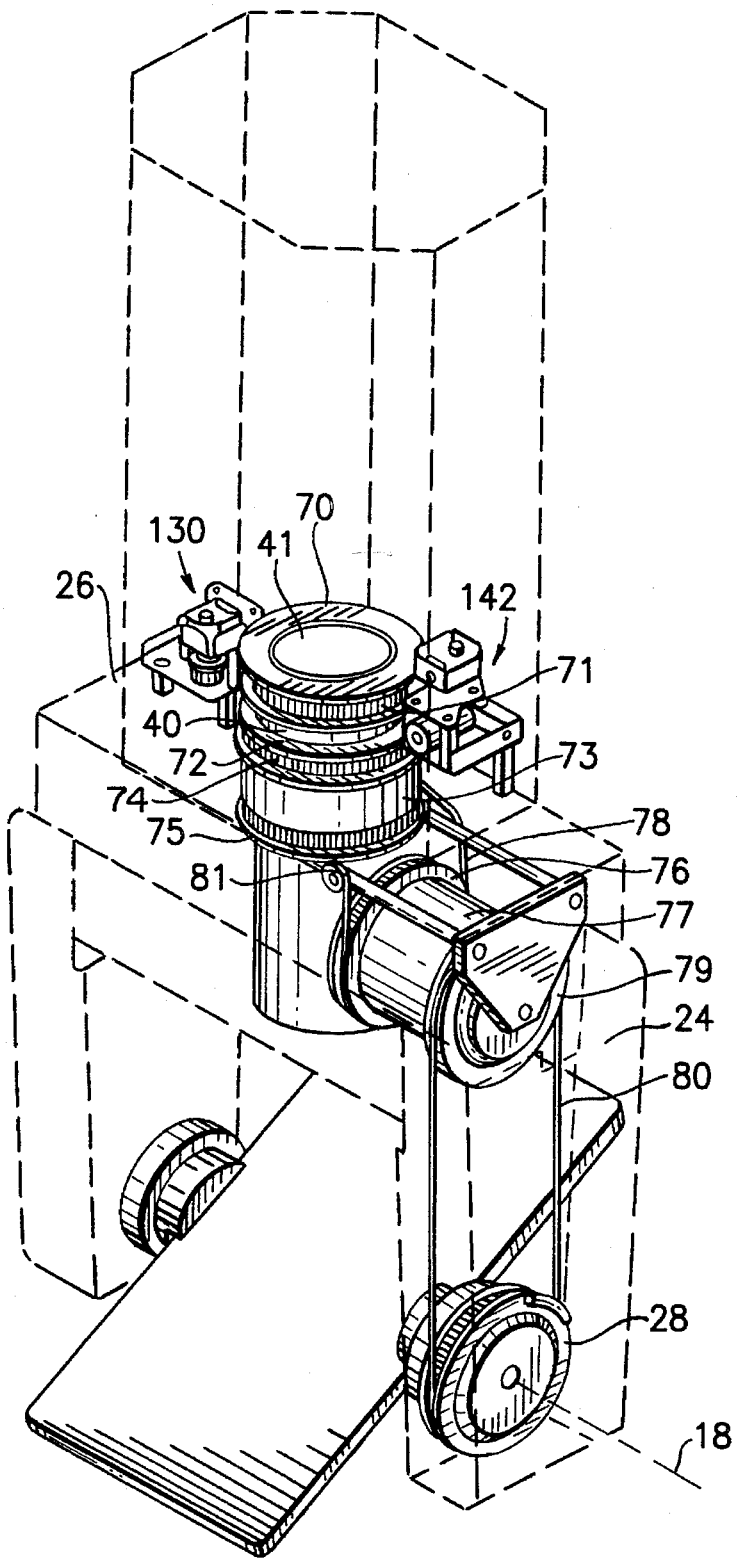
FIG. 9 is a perspective phantom view of the embodiment of FIG. 8.

Referring to FIGS. 8 and 9, another aspect of the invention will now be described. These alternative embodiments of the invention provide integral lighting units capable of a full range of pan and tilt beam positioning without the need for moving either the pan and tilt motors or the lighting, optical and cooling components of the luminaire.

In FIG. 8, the two-sided mirror device 16 is mounted for pan and tilt movement in a yoke assembly 84, which is coupled to a lamp enclosure 82 such that a light beam is projected along axis 38 through pan tube 40 and onto a reflective surface of mirror device 16. The lamp enclosure 82 houses a complete illumination system for producing the various effects provided by modern stage-lighting luminaries. Included in the lamp enclosure 82 are a lamp 61 and reflector 62 for directing light produced by the lamp through color wheels 63 and gobo wheel 90 to lens 65. Lens 65 directs the light along axis 38 in the form of a light beam, the intensity of which can be varied by a mechanical iris 67. The color wheels 63, gobo wheel 90, lens 65 and iris 67 are adjustable by means of motors 64, 91, 66 and 68, respectively. The projected beam passes through the hollow portion 41 of pan tube 40 and is reflected by mirror device 16.

Figure 18:
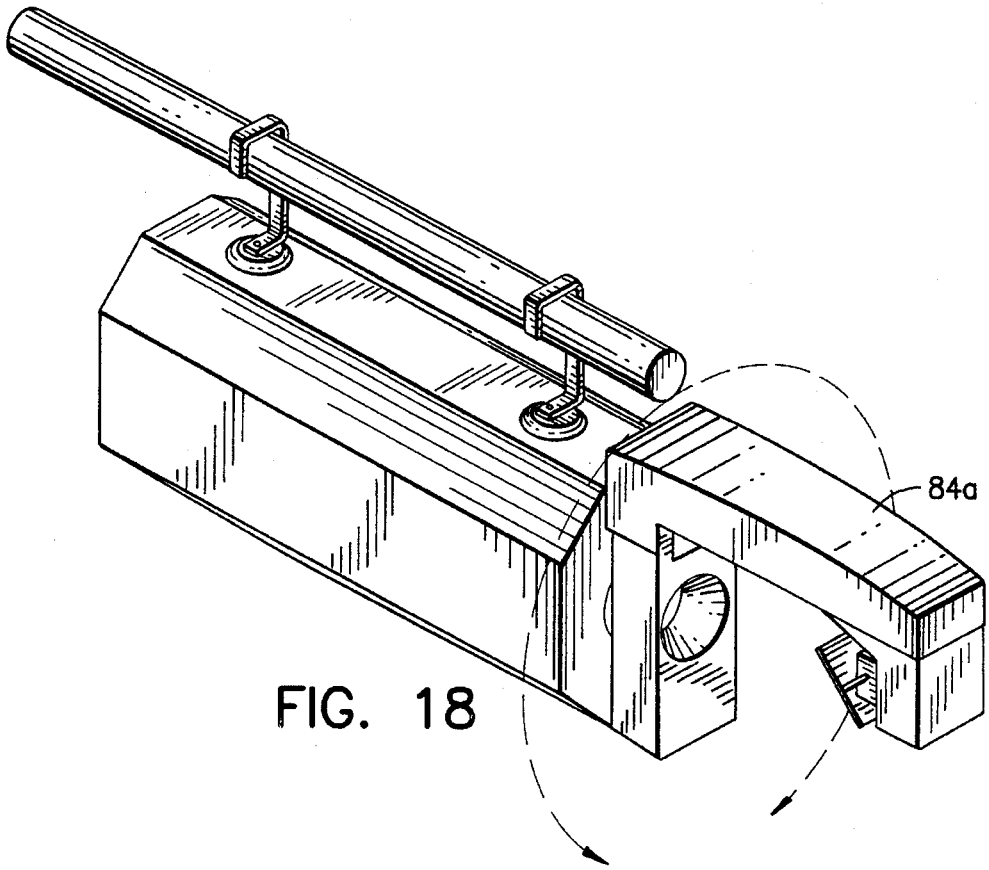
FIG. 18 shows another embodiment of an integrated lighting instrument and light modifier in accordance with the invention.

Pan and tilt motor assemblies 130 and 142 are fixedly mounted within the lamp enclosure 82 and coupled to the yoke assembly 84 by a combination of drive elements which can translate the radial force generated by motor assemblies 130 and 142 into tilt and pan motion, respectively, of the mirror element 16. Such movement is effected without moving the lamp enclosure. Referring to FIG. 9, a pan drive pulley 70, fixedly mounted to the pan tube 40, is coupled by a drive belt 71 to the pan motor assembly 142. Pan motion is effected by rotation of pulley 70, which is fixedly coupled to pan tube 40 and yoke cross member 26, which causes the yoke assembly 84 to move in the pan direction. It is to be noted that a suitable yoke assembly can include either a pair of yoke arms, such as, **84*a* and 84*b* in FIG. 8, or a single yoke arm, such as 84*a* in FIG. 18**.

A pair of tilt pulleys 72 and 75, non-rotatably coupled to one another, are mounted for free rotation about the pan tube 40, such that the pan tube and the pair of pulleys may rotate independently. Non-rotatable coupling of pulleys 72 and 75 is provided by mounting the pulleys to a connecting tube 73. Pan tube 40 passes through the connecting tube 73 so that the two tubes can rotate independently.

Pulley 72 is coupled by a drive belt 74 to the tilt motor assembly 130. Pulley 75 is coupled by a second tilt drive belt 78 to a third tilt pulley 76, which is mounted for free rotation about an axis perpendicular to pan axis 38 and parallel to tilt axis 18. A pair of idler pulleys 81 allow this drive belt to "turn the corner." The third tilt pulley 76 is coupled by a second connecting tube 77 to a fourth tilt pulley 79 mounted in the corner formed by the intersection of yoke arm 24 and cross member 26, and is coupled by a final tilt axis drive belt 80 to tilt pulley 28. Tilt motion occurs when tilt motor assembly 130 causes pulley 72 to rotate by means of belt 74. Because pulleys 72 and 75 are non-rotatably coupled via tilt tube 73, pulley 75 will likewise rotate. Rotation of pulley 75 is transferred to pulleys 76 and 79 (non-rotatably coupled to one another) via belt 78 and idler pulleys 81. Pulley 79, in turn, causes rotation of pulley 28, and hence mirror device 16, about tilt axis 18 via belt 80. Mirror device 16 can be rotated a full 360° about axis 18 to allow a full range of tilt positions and beam flipping.

Any incidental movement of the mirror about the tilt axis when the drive arrangement is actuated by the pan motor is automatically compensated for when the local control system described in U.S. Pat. No. 4,890,806 to Taylor et al is employed, since any incidental or externally induced movement about the title axis is detected by the optical encoder 36 and corrected as required to maintain the commanded position of the mirror.

With the embodiment of FIGS. 8 and 9, pan and tilt motion of the two-sided mirror device of the present invention is accomplished without repositioning of either the pan and tilt motors, or the optical, illumination and cooling systems. Accordingly, low-inertial, two-axis beam steering is accomplished with only a single mirror surface in the beam path at any time. Furthermore, high-speed, continuous beam steering in either the pan or tilt directions is accomplished, as the angular velocity of the light beam is twice that of the mirror device. Rapid beam repositioning and flipping is also facilitated by providing mirror device 16 with reflective surfaces on each side.

Figure 10:
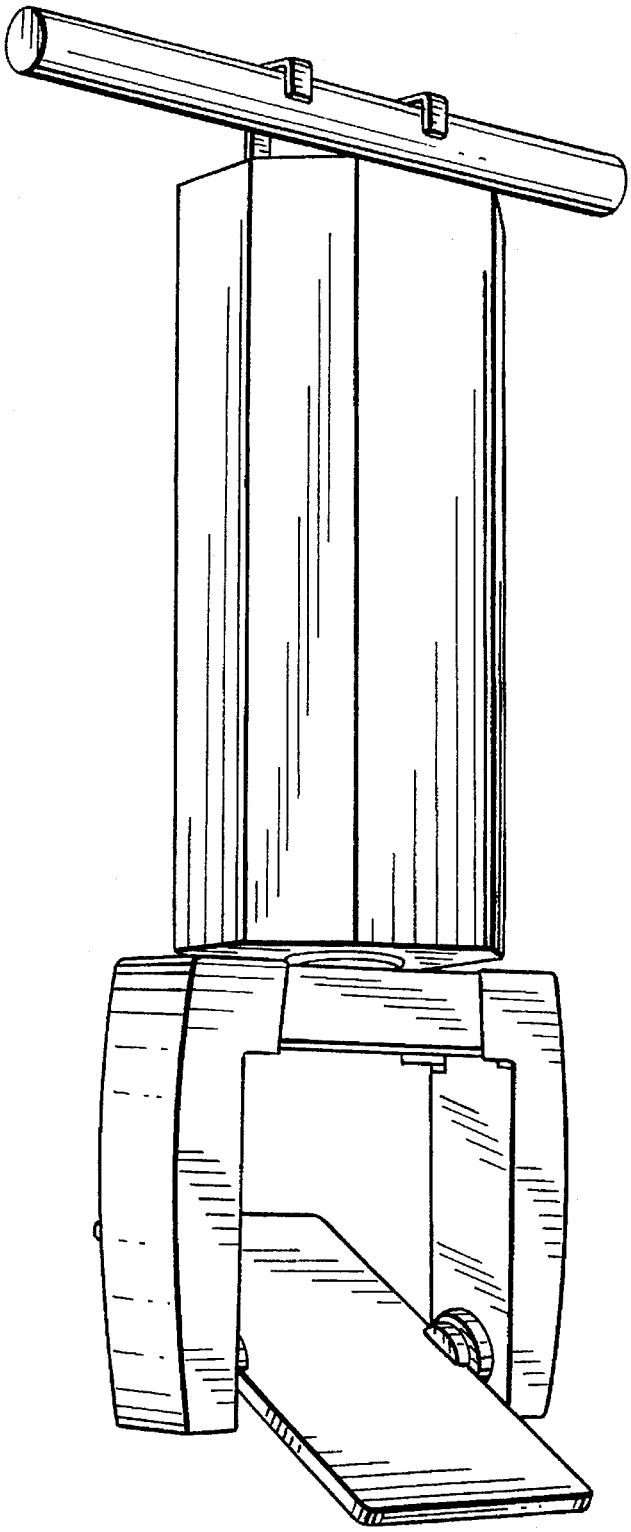
FIG. 10 is a perspective view of a vertically-oriented integrated variable lighting instrument.
Figure 11:
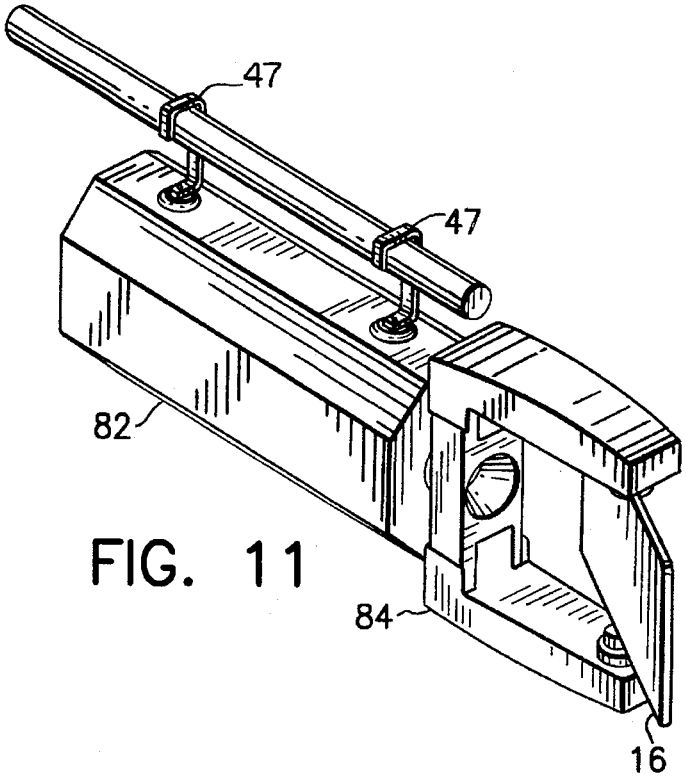
FIG. 11 is a perspective view of a horizontally-oriented integrated variable lighting instrument, second embodiment.

A lighting instrument utilizing a two-sided mirror device according to the present invention may be used in a vertical orientation as shown in FIG. 10. Alternatively, such a lighting instrument may be used in a horizontal orientation as shown in FIG. 11. In the latter embodiment, hooks 47 are mounted on one side of enclosure 82. In either orientation, 360degree beam coverage can be obtained in both pan and tilt directions. Some beam distortion may occur with the use of the vertical hang of FIG. 10, resulting when the mirror is turned substantially edgewise in the beam, thereby allowing the beam to shine straight down. Shadows cast by the mirror in edgewise orientation to the beam can be minimized by making the two-sided mirror device as thin as possible. In either embodiment, the beam can also be directed back into its source, if so desired, by placing the mirror perpendicular to the beam path. This can be used for effect, and illustrates the 360 degree range of coverage possible in elevation (tilt) adjustment.

Figure 12:
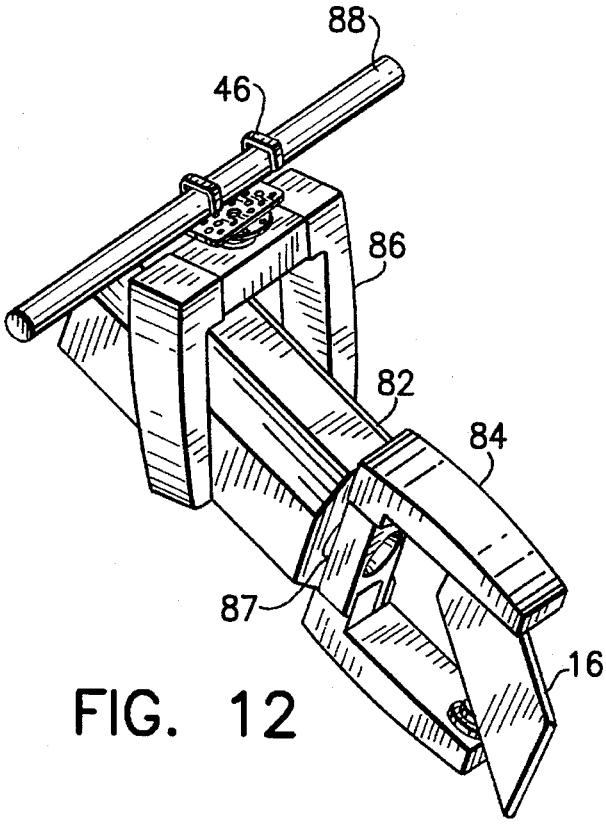
FIG. 12 is a perspective view of another integrated lighting instrument and light modifier.

In a further aspect of the invention, shown in FIG. 12, a two-sided mirror device 16 is mounted for pan and tilt movement in a yoke assembly 84, the yoke assembly 84 being mounted at the exit aperture 87 of lamp enclosure 82. The lamp enclosure 82 is itself mounted for pan and tilt movement in a second yoke assembly 86 which is suspended from a pipe or lighting truss section 88 by truss hook 46. The resulting luminaire is capable of high-speed beam steering and flipping in 360° degrees due to the action of mirror device 16 mounted in yoke assembly 84, and is also capable of slow, gracefully executed beam steering movement due to the action of lamp enclosure 82 mounted in yoke assembly 86. Further, lamp enclosure 82 can be re-positioned to better utilize the range of beam steering movement achieved by mirror device 16 mounted in yoke assembly 84. A further advantage of the embodiment shown in FIG. 12, is that illumination of a single, stationary subject can be achieved from a variety of different angles by a single luminaire.

Any of the lighting instruments shown in FIGS. 8 through 12, 15 and 18 may include one or more lenses mounted to or within pan tube 40 to better utilize the space enclosed therein for making other improvements to the optical system and its performance. For example, the pan tube might house a multi-element, movable lens system 89*c* and 89*d* functioning as a zoom lens apparatus. As another example, a series of lenses 89*a* and 89*b*, for example, might be employed to reduce the diameter of a light beam as it enters pan tube 40 and thereafter enlarge the light beam as it exits the pan tube.

Figure 15:
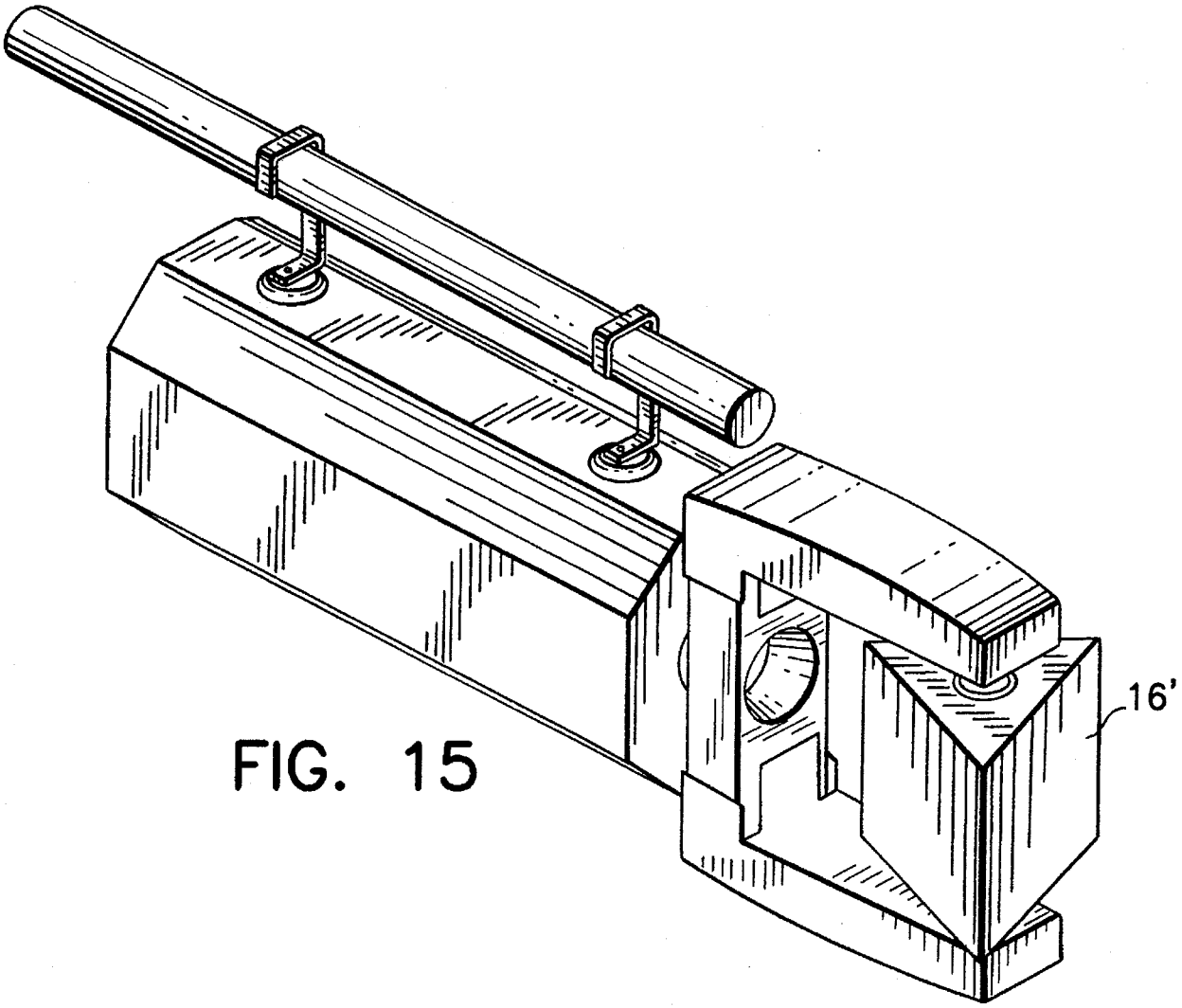
FIG. 15 shows another embodiment of an integrated lighting instrument and light modifier in accordance with the invention.
Figure 16:
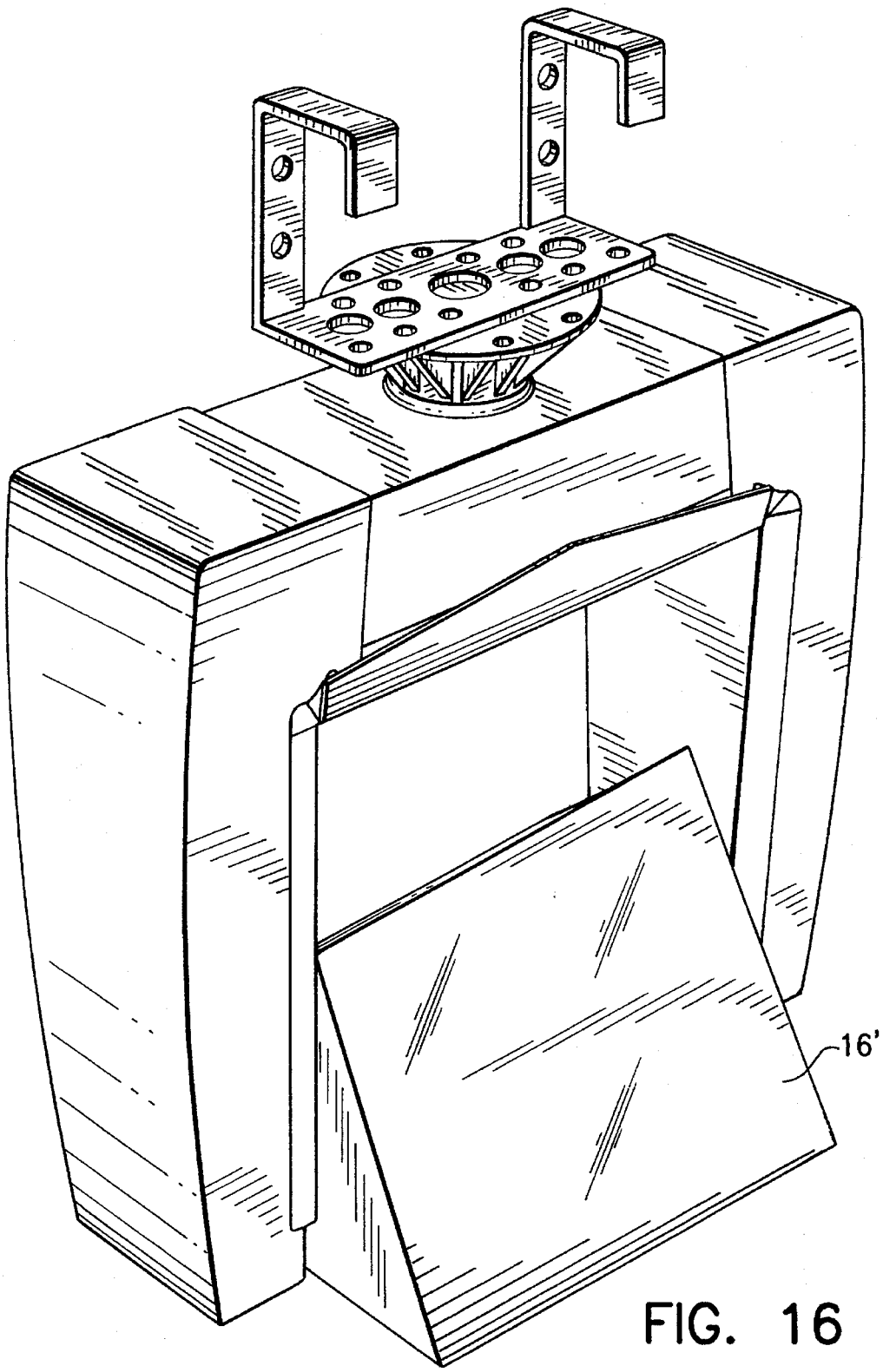
FIG. 16 shows another embodiment of a variable light modifier in accordance with the invention.

It is to be understood that the present invention is not limited to the use of a single or dual sided mirror. As seen in FIG. 15, an integrated lighting unit and light modifier in accordance with the invention can include a three-sided mirror device 16'. Similarly, as seen in FIG. 16, a variable light modifier per se in accordance with the invention can also include a three-sided mirror device 16'. Embodiments employing mirror devices having more than three reflective surfaces are also within the scope of the invention.

Although several embodiments of the invention have been illustrated in the accompanying Figures and described in the foregoing Detailed Description, it will be understood that the invention is capable of numerous rearrangements, modifications and substitutions without departing from the scope of the invention.

We claim:

1. A stage lighting system, comprising:

a light source for generating a high intensity light beam and means for directing the beam along an optical axis; and a separate light modifier disposed along the optical axis for redirecting the beam in a pan and in a tilt direction, said modifier comprising:

a reflector rotatable in 360 degrees about a first axis intersecting the optical axis and in 360 degrees about a second axis orthogonal to the first axis for reflecting said light beam, a first drive for rotating said reflector about said first axis, and a second drive for rotating said reflector about said second axis.

2. The system according to claim 1, further comprising a second light source for generating a second high intensity light beam and directing the second beam along a second optical axis intersecting said reflector.

3. The system according to claim 2, wherein said first and second optical axes are not coaxial.

4. The system according to claim 1, wherein said reflector comprises a dual-sided reflector unit having two reflective planar surfaces facing in opposite directions.

5. The system according to claim 1, wherein said reflector comprises a single reflective planar surface.

6. The system according to claim 2, wherein said reflector comprises a dual-sided reflector unit having two reflective planar surfaces facing in opposite directions.

7. The system according to claim 6, wherein said reflector is positionable to simultaneously redirect said first and second light beams from only one of said reflective planar surfaces.

8. The system according to claim 2, wherein said reflector is positionable to simultaneously redirect said first and second light beams from said single reflective planar surface.

9. The system according to claim 6, wherein said reflector is positionable to simultaneously redirect said first and second light beams each from a different one of said reflective planar surfaces.

10. A luminaire, comprising:

a lamp housing having a first axis;

a lamp located within said lamp housing for generating a light beam and means for directing the beam along the first axis;

a yoke housing rotatably coupled to said lamp housing, the yoke housing being rotatable in 360 degrees relative to the lamp housing;

a first drive for rotating said yoke housing about said first axis;

a reflector disposed along the first axis and positionable to directly receive said light beam, said reflector being rotatably coupled to said yoke housing about a second axis orthogonal to the first axis, said reflector being rotatable in 360 degrees relative to the yoke housing; and a second drive for rotating said reflector about the second axis.

11. The luminaire according to claim 10, wherein said first and second drives are located within said yoke housing.

12. The luminaire according to claim 10, wherein said reflector includes first and second planar reflective surfaces.

13. The luminaire according to claim 10, wherein said reflector includes only one reflective planar surface.

14. The luminaire according to claim 10, wherein said lamp housing is fixedly coupled to a stationary object.

15. The luminaire according to claim 10, further comprising a second yoke assembly, said second yoke assembly being rotatably coupled to a stationary object and said luminaire being rotatably coupled to said second yoke assembly, whereby said luminaire can be rotated in over 360° degrees along two coordinate axes.

16. A variable light modifier comprising:

a yoke housing having a cross member and an arm extending from one end of said cross member;

a reflector rotatably coupled to said arm having an axis of rotation, wherein said axis of rotation is substantially orthogonal to said arm, said reflector having at least two planar reflective surfaces;

a drive mounted in said arm, said drive coupled to said reflector for rotating said reflector through at least 360degrees about a first axis parallel to said cross member; and a mounting rotatably coupling said yoke housing to a stationary object.

17. The variable light modifier of claim 16 further comprising:

a yoke drive for rotating said yoke housing through at least 360 degrees about a second axis orthogonal to said first axis.

18. The variable light modifier of claim 17 wherein said yoke drive is located within said yoke housing.

19. A method for variably redirecting a beam of high intensity light directed along an optical axis, comprising the steps of:

intersecting said beam with a driven reflector having first and second reflective surfaces, said reflector capable of 360degree rotation about first and second axes;

driving the reflector about the first axis to redirect the beam in a first direction; and driving the reflector about the second axis perpendicular to the first axis to redirect the beam in a second direction.

20. The method according to claim 19, further comprising the steps of directing said light beam toward the first reflective surface and directing a second light beam toward the second reflective surface.

21. The method according to claim 19, further comprising the steps of providing a second light beam and directing both said light beam and said second light beam toward one of said reflective surfaces.

22. The system according to claim 1, wherein said reflector comprises three or more reflective surfaces.

23. The luminaire according to claim 10, wherein said reflector includes three or more reflective surfaces.

24. The variable light modifier according to claim 16, wherein said reflector includes two planar reflective surfaces facing in opposite directions.

25. The variable light modifier according to claim 16, wherein said reflector includes three or more reflective surfaces.

26. The variable light modifier according to claim 16, wherein a second arm extends from an opposite end of said cross member and said reflector is rotatably attached between said arms.

27. A stage lighting system, comprising:

a high intensity light source enclosed within a light source housing and means for producing a light beam along an optical axis; and a variable light modifier operable to redirect said beam from said optical axis, said modifier comprising a second housing incorporating an arm fixedly attached to a cross member, said cross member rotatably coupled to a stationary support, a drive mounted in said second housing operable to rotate said second housing about said support, a substantially planar double sided reflector rotatably supported at an edge of said reflector by said arm, and a drive mounted in said second housing operable to rotate said reflector through at least 360 degrees about an axis parallel to said cross member.

28. The lighting system of claim 27 wherein said second housing is yoke shaped, said cross member supports two arms and said reflector is supported at one edge by each arm.

29. The lighting system of claim 27 further comprising a second high intensity light source enclosed within a second light source housing capable of producing a second light beam and means for directing the second beam along a second optical axis intersecting said reflector.

30. The luminaire of claim 10, further comprising a passage through said yoke housing substantially concentric with said first axis, through which said beam must pass prior to intersecting said reflector.

31. The luminaire of claim 30, further comprising non-reflector beam modifying elements positioned in said passage.

32. The variable light modifier of claim 16 wherein said drive is controllable by a microprocessor.

33. The variable light modifier of claim 16 wherein said drive includes drive data stored in memory.

34. The variable light modifier of claim 16 wherein said rive is remotely controlled.

35. An integrated lighting instrument and light modifier, comprising:

a lamp housing enclosing a high intensity light source, and a beam forming reflector capable of producing a beam directed along an optical axis from light emanating from said source;

a beam steering housing drivably mounted to said lamp housing such that said beam steering housing is rotatable through 360° about an axis substantially coincident with said optical axis;

a substantially planar double sided beam steering reflector rotatably mounted to said beam steering housing;

a passage through said beam steering housing substantially coincident with said optical axis, through which said beam must pass prior to intersecting said beam steering reflector; and a beam steering reflector drive, supported by said beam steering housing remote from said passage, said beam steering reflector drive rotatably coupled to said beam steering reflector, whereby activation of said beam steering reflector drive rotates said beam steering reflector about an axis substantially orthogonal to said optical axis.

36. A stage lighting system, comprising:

a light source comprising a lamp and a first reflector mounted in a housing having an optical axis, said lamp and said first reflector generating a high intensity light beam and directing the beam along said optical axis; and a separate light modifier disposed along the optical axis for redirecting the beam in a pan and in a tilt direction, said modifier comprising:

a second reflector rotatable in 360 degrees about a first axis intersecting the optical axis and in 360° degrees about a second axis orthogonal to the first axis for reflecting said light beam, a first drive for rotating said second reflector about said first axis, and a second drive for rotating said second reflector about said second axis.

37. The system according to claim 36, further comprising a second light source for generating a second high intensity light beam and directing the second beam along a second optical axis intersecting said second reflector.

38. A luminaire, comprising:

a lamp housing having a first axis;

a lamp and a first reflector located within said lamp housing for generating a light beam and directing the beam along the first axis;

a yoke housing rotatably coupled to said lamp housing, the yoke housing being rotatable in 360 degrees relative to the lamp housing;

a first drive for rotating said yoke housing about said first axis;

a second reflector disposed along the first axis and positionable to directly receive said light beam, said second reflector being rotatably coupled to said yoke housing about a second axis orthogonal to the first axis, said second reflector being rotatable in 360 degrees relative to the yoke housing; and a second drive for rotating said second reflector about the second axis.

39. A stage lighting system, comprising:

a high intensity light source comprising a lamp and a first reflector enclosed within a light source housing, said lamp and said first reflector producing a light beam along an optical axis; and a variable light modifier operable to redirect said beam from said optical axis, said modifier comprising a second housing incorporating an arm fixedly attached to a cross member, said cross member rotatably coupled to a stationary support, a drive mounted in said second housing operable to rotate said second housing about said support, a substantially planar double sided second reflector rotatably supported at an edge of said second reflector by said arm, and a drive mounted in said second housing operable to rotate said second reflector through at least 360 degrees about an axis parallel to said cross member.

40. The lighting system of claim 38 further comprising a second high intensity light source comprising a second lamp and a third reflector enclosed within a second light source housing, said second lamp and said third reflector producing a second light beam and directing the second beam along a second optical axis intersecting said second reflector.

* * * * *